US010239723B2

(12) United States Patent
Hongu

(10) Patent No.: US 10,239,723 B2
(45) Date of Patent: Mar. 26, 2019

(54) SHEET PROCESSING APPARATUS AND IMAGE FORMING APPARATUS

(71) Applicant: CANON KABUSHIKI KAISHA, Tokyo (JP)

(72) Inventor: Shigeo Hongu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/901,152

(22) Filed: Feb. 21, 2018

(65) Prior Publication Data

US 2018/0179015 A1 Jun. 28, 2018

Related U.S. Application Data

(63) Continuation of application No. 15/091,095, filed on Apr. 5, 2016, now Pat. No. 9,932,198, which is a (Continued)

(30) Foreign Application Priority Data

Jul. 22, 2013 (JP) ..... 2013-151638

(51) Int. Cl.
*B65H 31/38* (2006.01)
*B65H 43/06* (2006.01)
(Continued)

(52) U.S. Cl.
CPC ..... *B65H 43/06* (2013.01); *B42B 9/00* (2013.01); *B65H 9/10* (2013.01); *B65H 31/3081* (2013.01);
(Continued)

(58) Field of Classification Search
CPC ..... B65H 37/04; B65H 9/10; B65H 31/34; B65H 2801/27; B42C 1/12
(Continued)

(56) References Cited

U.S. PATENT DOCUMENTS 7,281,707 B2 10/2007 Moriyama et al.
7,410,158 B2 8/2008 Iida et al.
(Continued)

FOREIGN PATENT DOCUMENTS

JP H11-139663 A 5/1999
JP 2000-016683 A 1/2000
(Continued)

OTHER PUBLICATIONS

Office Action dated Aug. 8, 2017, in Japanese Patent Application No. 2013-151638.
(Continued)

*Primary Examiner* — Leslie A Nicholson, III
(74) *Attorney, Agent, or Firm* — Venable LLP

(57) ABSTRACT

There is provided a sheet processing apparatus with improved visibility of a sheet bundle discharged without post-processing thereto. The CPU circuit receives the conveyed sheet, drives and controls the sheet-returning paddle, the rack part, the rear end regulation part, the alignment plate and the like and forms sheet bundle comprising of a plural number of sheets as received. Further, the CPU circuit drives and controls the alignment plate when discharging the sheet bundle S from the processing tray, the sheet bundle S exceeding the number of sheets which can be post-processed by the stapler. Therefore, the sheet bundle S which includes sheets equal to the allowable number of sheets for post-processing of the sheet processing unit is discharged to the second discharge position which is different from the first discharge position.

18 Claims, 5 Drawing Sheets

Related U.S. Application Data continuation of application No. 14/329,328, filed on Jul. 11, 2014, now Pat. No. 9,334,139.

(51) Int. Cl.

| | |
|---|---|
| ***B42B 9/00*** | (2006.01) |
| ***B65H 31/34*** | (2006.01) |
| ***B65H 9/10*** | (2006.01) |
| ***B65H 37/04*** | (2006.01) |
| ***B65H 31/30*** | (2006.01) |
| ***B65H 33/08*** | (2006.01) |
| ***G03G 15/00*** | (2006.01) |

(52) U.S. Cl.

CPC ..... *B65H 31/34* (2013.01); *B65H 31/38* (2013.01); *B65H 33/08* (2013.01); *B65H 37/04* (2013.01); *G03G 15/6547* (2013.01); *B65H 2301/4212* (2013.01); *B65H 2301/4213* (2013.01); *B65H 2402/10* (2013.01); *B65H 2511/30* (2013.01); *B65H 2513/42* (2013.01); *B65H 2801/27* (2013.01); *G03G 2215/00911* (2013.01)

(58) Field of Classification Search

USPC ..... 270/58.07, 58.08, 58.11, 58.12, 58.17, 270/58.27; 412/33

See application file for complete search history.

(56) References Cited

U.S. PATENT DOCUMENTS

| | | | |
|---|---|---|---|
| 7,413,177 | B2 | 8/2008 | Mori et al. |
| 7,510,177 | B2 | 3/2009 | Nagata et al. |
| 7,931,262 | B2 | 4/2011 | Ochi et al. |
| 8,177,214 | B2 | 5/2012 | Sato |
| 8,246,033 | B2 | 8/2012 | Sato |
| 8,444,133 | B2 | 5/2013 | Kumura |
| 2011/0304090 | A1 | 12/2011 | Kimura |
| 2013/0328258 | A1 | 12/2013 | Mutsuno |

FOREIGN PATENT DOCUMENTS

| | | | |
|---|---|---|---|
| JP | 2000-044109 | A | 2/2000 |
| JP | 2003-012223 | A | 1/2003 |
| JP | 2005-306580 | A | 11/2005 |
| JP | 2007-310306 | A | 11/2007 |
| JP | 2008-207883 | A | 9/2008 |
| JP | 2011-184153 | A | 9/2011 |
| JP | 2011-256009 | A | 12/2011 |

OTHER PUBLICATIONS

Office Action dated Apr. 25, 2017, in Japanese Patent Application No. 2013-151638.

Office Action dated Dec. 4, 2018, in Japanese Patent Application No. 2017-206870.

SHEET PROCESSING APPARATUS AND IMAGE FORMING APPARATUS

This is a continuation of U.S. patent application Ser. No. 15/091,095, filed Apr. 5, 2016, which is a continuation of U.S. patent application Ser. No. 14/329,328, filed Jul. 11, 2014, now U.S. Pat. No. 9,334,139.

BACKGROUND OF THE INVENTION

Field of the Invention

The present invention relates to a sheet processing apparatus, which performs post-processing to a sheet bundle formed of a plurality of sheets having an image formed thereon in an image forming system such as a copying machine, a multifunction peripheral and the like.

Description of the Related Art

Conventionally, a sheet processing apparatus (post-processing apparatus: finisher) which performs an aligning process, a binding process and a punching process are known. In the aligning process, a plural number of sheets discharged from the image forming apparatus are received onto a processing tray. The received sheets are bound into a sheet bundle. By the binding process and the punching process, a predetermined portion of the sheet bundle is bound. The post-processing function of the sheet processing apparatus limits the number of sheets of the sheet bundle which can be post-processed. One of the reasons for this is because there is a limit of an opening height of a binding section of a stapler.

On the other hand, before a document reading apparatus finishes reading of the all pages, the image forming apparatus sequentially starts to form image of a document having finished reading. Then, the image forming apparatus promptly outputs the sheet on which an image has been formed. It means that, the sheet processing apparatus receives sheets before a page configuration of the sheet bundle (for example, the number of sheets) subject for the post-processing is determined.

For example, description is made in a case where it is determined in the middle of forming the sheet bundle that the number of sheets exceeds the upper limit number of sheets which can be post-processed. In this case, the sheet processing apparatus does not perform the post-processing to the sheet bundle so as not to interrupt the operation of the apparatus. Instead, the sheet processing apparatus discharges the sheet bundle to a stack tray even if not all sheets of the sheet bundle have been received.

In this case, however, the sheet bundle which was post-processed and completed normally (normal bundle) and the sheet bundle which was not post-processed due to the excess of the upper limit number of sheets (exceptional bundle) are discharged at the same position. Therefore, there is a problem that the discharged sheet bundles cannot be distinguished respectively.

Japanese Patent Laid-Open No. 2000-016683 describes an image forming system to this problem. In the image forming system disclosed in Japanese Patent Laid-Open No. 2000-016683, a stack tray (shift tray) adapted for shift operation is employed. The stack tray enables to shift a stack position when the sheet bundle having failed to be post-processed is discharged as an unprocessed sheet bundle to sort the respective discharged bundles.

On the other hand, in a sheet processing apparatus such as an inner finisher which is placed in a space between a printing part and reader part of the image forming apparatus, it is not easy to provide a shift tray whose configuration easily interferes with peripheral devices.

In addition, in order not to deteriorate productivity in image formation, the post-processed sheet bundles are discharged and stacked to the position at which the sheet bundles are post-processed or close thereto. This helps to reduce time required to change positions such as discharge position. This is also applied in case of the exceptional bundle. For example, in a case where the exceptional bundle is occurred while running a designated job of "depth binding process", which is a post-processing performed at a depth position when viewed from the front of the image forming apparatus, the exceptional bundle is placed at a depth position on a discharge tray. Therefore, this leaves a problem that, in an inner finisher having a small open space, when a user checks the sheet bundle discharged onto the stack tray, the visibility of the sheet bundle is decreased

SUMMARY OF THE INVENTION

The sheet processing apparatus of the present disclosure comprises, in a sheet processing apparatus configured to perform a post-processing to a sheet having an image formed thereon, a bundle forming unit configured to receive the sheet conveyed along with a conveyance path to form a sheet bundle including a plurality of received sheets; a sheet processing unit configured to perform post-processing to the sheet bundle formed by the bundle forming unit; a bundle shift unit configured to shift the sheet bundle formed by the bundle unit in a direction different from a conveyance direction, and a control unit configured to control the bundle shift unit so as to discharge the sheet bundle to a first discharge position or a second discharge position. The control unit controls the bundle shift unit such that 1) a sheet bundle which includes sheets less than or equal to the allowable number of sheets for post-processing of the sheet processing unit is discharged to the first discharge position, and 2) a sheet bundle which includes sheets equal to the allowable number of sheets for post-processing of the sheet processing unit is discharged to the second discharge position which is different from the first discharge position.

Further features of the present invention will become apparent from the following description of exemplary embodiments with reference to the attached drawings.

DESCRIPTION OF THE EMBODIMENTS

Various exemplary embodiments, features, and aspects of the present disclosure are described below in detail with reference to the drawings.

According to the present disclosure, there is provided a sheet processing apparatus with improved visibility of a sheet bundle discharged without post-processing thereto.

Further, according to the present disclosure, a sheet bundle which exceeds the number of sheets which can be post-processed by the sheet processing unit (exceptional bundle) is shifted to a second discharge position where is different from a first discharge position. Thereafter, the sheet bundle is discharged. Therefore, visibility of the sheet bundle discharged without being post-processed is improved.

[Overall Configuration of the Apparatus]

Figure 1:
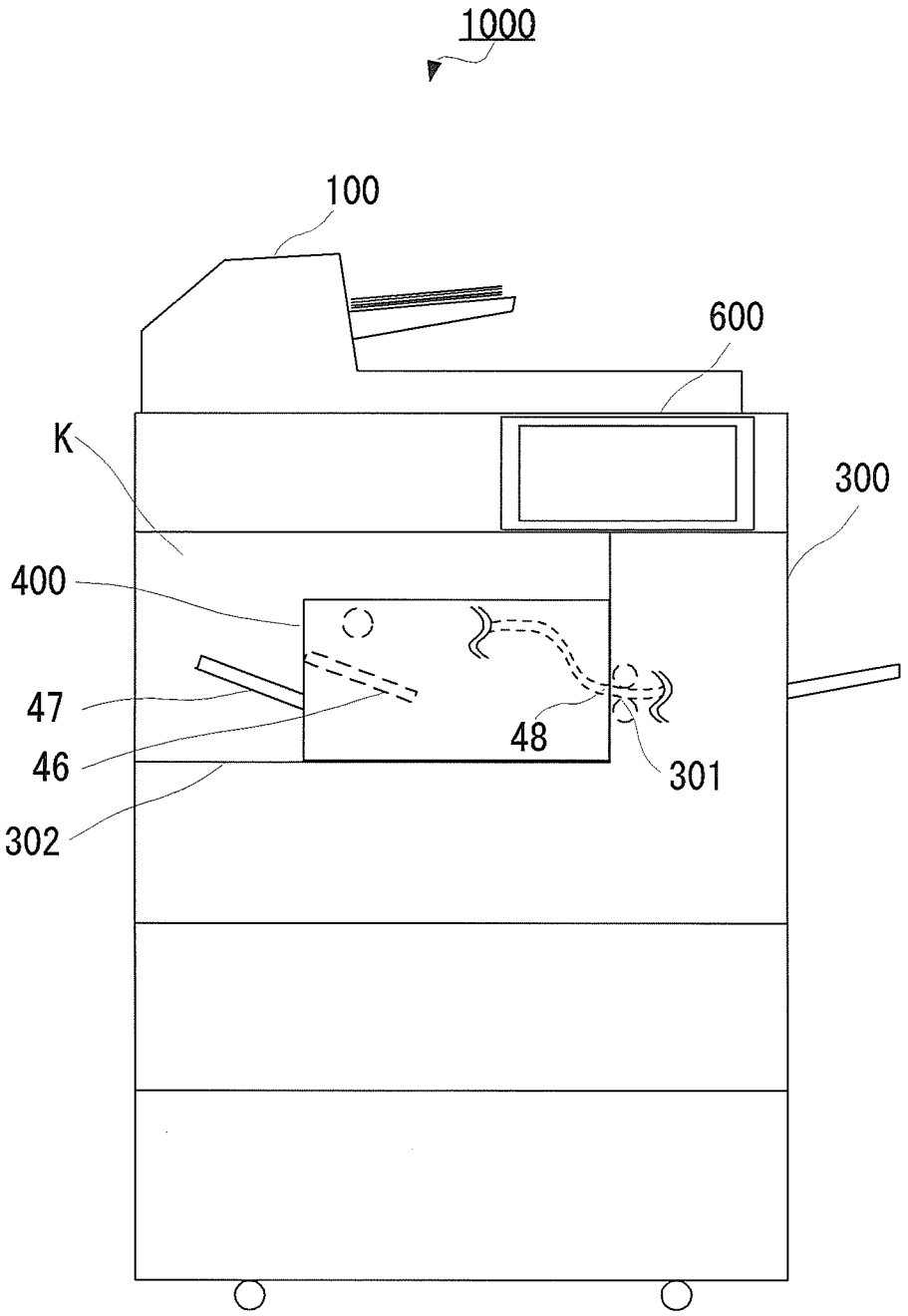
FIG. 1 is a diagram exemplifying an overall configuration of an image forming system.

FIG. 1 is a diagram exemplifying an overall configuration of an image forming system 1000 according to the present embodiment. The image forming system 1000 is comprised of a document reading apparatus 100, an image forming apparatus 300, a sheet processing apparatus 400, which is an example of a post-processing apparatus, and operation device 600.

As shown in FIG. 1, the sheet processing apparatus 400 is comprised of a processing tray 46 on which sheets are stacked for the post-processing, a stacking tray 47 on which the sheet discharged from the processing tray 46 is stacked.

The document reading apparatus 100 is disposed at an upper part of the image forming apparatus 300. The document reading apparatus 100 includes a sheet feeder (not shown) and an image reader (not shown). The sheet feeder automatically takes a document placed on a document tray onto a document glass table. The image reader reads the document taken onto the document glass table. The document reading apparatus 100 outputs the image data obtained by reading the document to the image forming apparatus 300. The image forming apparatus 300 forms an image on a sheet (for example, paper) based on the image data received from the document reading apparatus 100 and an image data received from an external device and the like connected via network.

The sheet having the image formed thereon is discharged from a paper discharge port of a discharge part 301. Note that, in a state where the sheet processing apparatus 400 is not installed in the image forming apparatus 300, the sheet having an image formed thereon is stacked in space K between the document reading apparatus 100 as a reader part and the image forming apparatus 300 as a printing part. Further, the stacked sheets are taken out of the image forming apparatus 300 through an opening 302 provided in the space K.

The sheet processing apparatus 400 performs post-processing including a process of receiving the sheet discharged from the discharge part 301 of the image forming apparatus 300 via a sheet feeding port 48 to align and bundle a plural number of sheets. The post-processing also includes a process to bind predetermined positions of the bundled sheet (stapling process).

As shown in FIG. 1, the sheet processing apparatus 400 of the present embodiment is an inner finisher type post-processing apparatus, which is adapted to be installed in space K between the document reading apparatus 100 as the reader part and the image forming apparatus 300 as the printing part. Therefore, a visible range from an upper direction is restricted by the document reading apparatus 100. For example, when a user checks a sheet on the stacking tray 47 from the opening 302, a space around the sheet processing apparatus 400 is narrow, as a result, its depth side is hardly visible. The detail of the configuration of the sheet processing apparatus 400 will be described later.

An operation device 600 receives an operation instruction from the user to the document reading apparatus 100, the image forming apparatus 300, and the sheet processing apparatus 400. In addition, the operation device 600 provides information such as process status to the user. The operation device 600 comprises a graphical user interface (GUI) screen (not shown). Through the screen, the user sets various jobs such as designating post-processing mode, which will be described later.

[Sheet Processing Apparatus]

Figure 2:
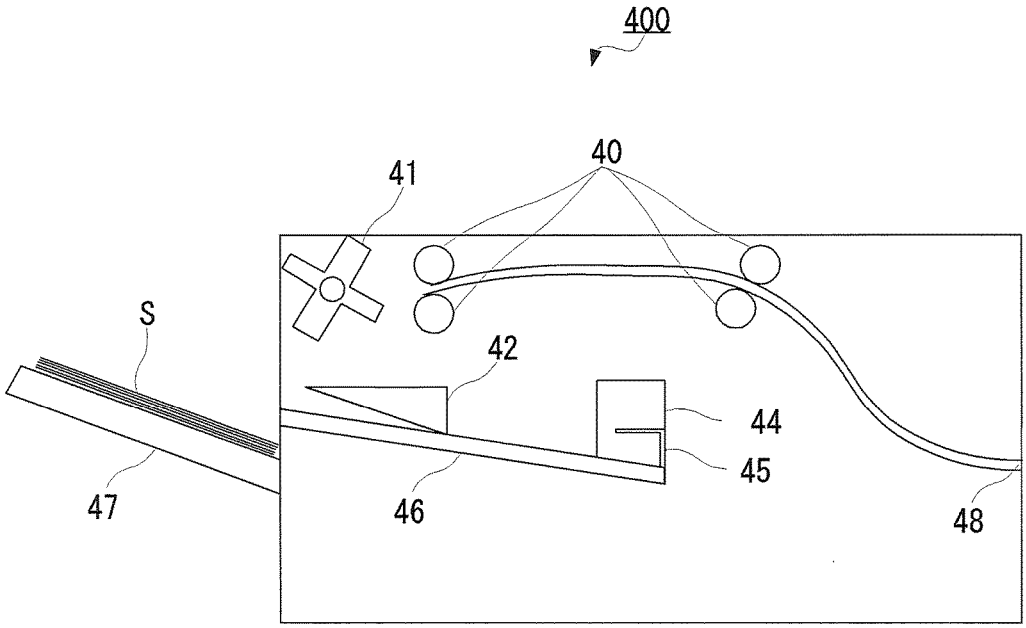
FIG. 2 is a schematic longitudinal sectional view exemplifying a configuration of a sheet processing apparatus.
Figure 3A:
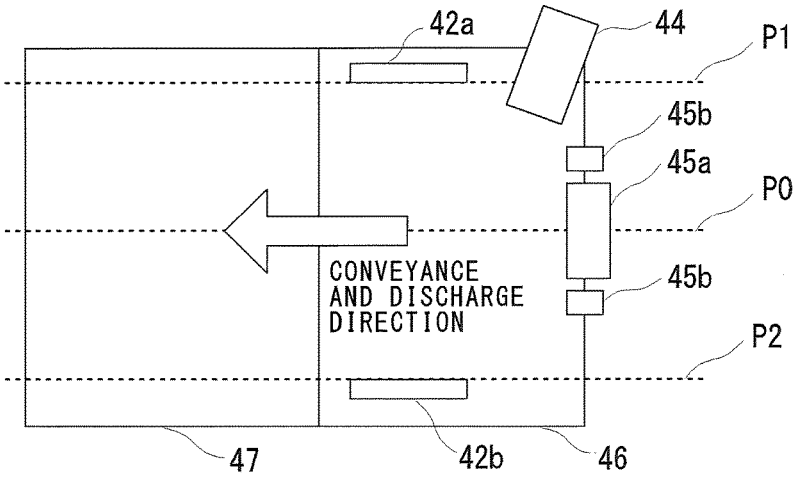
FIGS. 3A, 3B and 3C are top views of the sheet processing apparatus illustrating a situation where a plurality of sheets are aligned and bundled, bound, and conveyed thereafter.
Figure 3B:
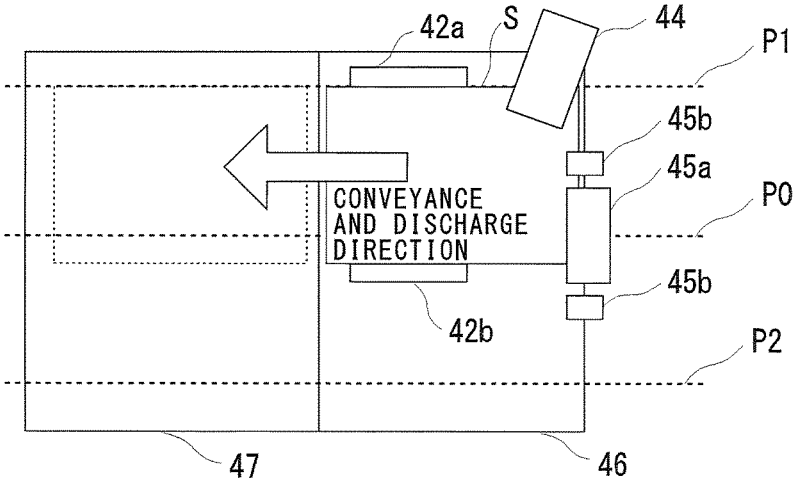
Figure 3C:
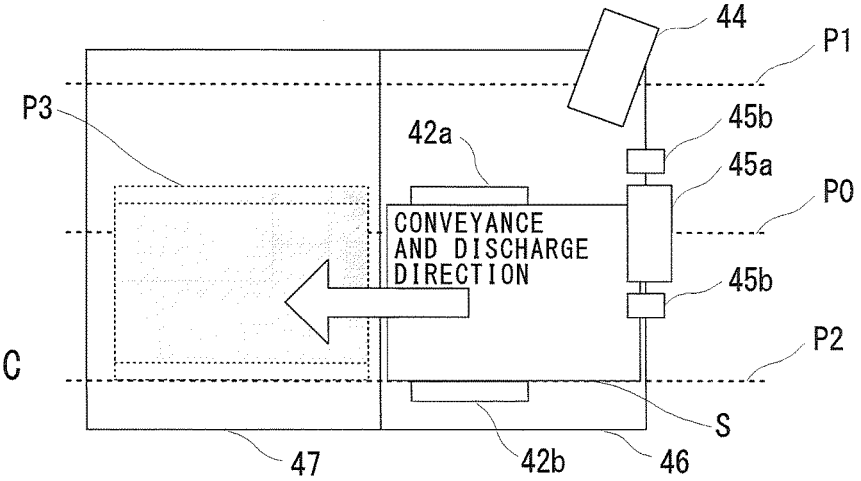

FIG. 2 is a schematic longitudinal sectional view exemplifying a configuration of a sheet processing apparatus 400. FIGS. 3A, 3B and 3C are top views of the sheet processing apparatus illustrating a situation where a plural number of sheets are aligned and bundled, bound, and conveyed thereafter. Referring to FIG. 2 and FIGS. 3A, 3B and 3C, a specific configuration and post-processing of the sheet processing apparatus 400 are described.

The sheet processing apparatus 400 includes conveyance roller pair 40, a sheet-returning paddle 41, an alignment plate 42, a stapler 44, a sheet bundle pushing rack part 45, a processing tray 46, a stacking tray 47 and a sheet feeding port 48. The sheet-returning paddle 41 moves up or moves down by a vertically driving mechanism (not shown).

The sheet processing apparatus 400 receives the sheet discharged from the paper discharge port of the image forming apparatus 300 one by one via the sheet feeding port 48. Then, the sheet processing apparatus 400 conveys the sheet as received along with a conveyance path by the rotatively driven conveyance roller pair 40. Then, by moving down the sheet-returning paddle 41, which rotates in a direction opposite to the conveyance direction, the sheet processing apparatus 400 guides the sheet drawn into the apparatus to the processing tray 46 to stack the sheet thereon. Further, the sheet processing apparatus 400 presses the sheet-returning paddle 41 against the end of the sheet stacked in the processing tray 46 for a predetermined time. Therefore, the other end of the sheet, which is opposite to the end having the sheet-returning paddle 41 pressed thereto, is abutted to the sheet bundle pushing rack part 45, which also acts as a rear end regulating plate. The sheet end abutting to the sheet bundle pushing rack part 45 is hereinafter referred to as a sheet rear end. In addition, a bundle of sheets stacked on the processing tray 46 is referred to as a sheet bundle.

As shown in FIG. 3A, the sheet bundle pushing rack part 45 is comprised of a rack part 45*a* and the rear end regulation part 45*b*. The rack part 45*a* is made movably in conveyance and discharge direction as shown by an arrow in FIG. 3A, which is driven by a pushing mechanism (not shown). Therefore, the sheet bundle stacked on the processing tray 46 is pushed out to the stacking tray 47, allowing the sheet bundle to be discharged from the processing tray 46. Further, the rear end regulation part 45*b* is a fixed member to which the sheet rear end is abutted. Therefore, the rear end of the sheet bundle is aligned.

As shown in FIG. 3A, the alignment plate 42 is comprised of an alignment plate 42*a* and an alignment plate 42*b*. The alignment plate 42*a* is positioned at a front upper side (depth side of the apparatus) and the alignment plate 42*b* is positioned at a front lower side in FIG. 3A (front side of the apparatus). Each of the alignment plate 42*a* and the alignment plate 42*b* are made movably in a direction orthogonal to the conveyance and discharge direction as shown by the arrow in FIG. 3A, which are driven by an alignment mechanism (not shown). The alignment plates 42*a* and 42*b* push and align both ends of the sheet bundle having the rear end thereof been aligned. By repeating these operations for each sheet, sheet bundle S (FIG. 3B) is formed. It means that the sheet bundle-pushing rack part 45, the alignment plate 42 and the like act as bundle forming unit.

For example, in a case where a "binding mode" which binds the sheet bundle S is selected in the operation device 600, a binding process is performed to the sheet bundle S as formed by the stapler 44. Thereafter, the sheet bundle S having performed the binding process thereto is pushed out by the pushing rack part 45*a* and stacked on the stacking tray 47.

Note that, in the present embodiment, description is made under an assumption that a direction to which the sheet bundle S stacked on the stacking tray 47 is taken out by the user (direction to take out) is toward the front side when viewed from the front side of the image forming system 1000 shown in FIG. 1. Note that, depending on how the sheet processing apparatus 400 is arranged in the image forming system 1000, the direction to take out the sheet bundle S can be determined.

[Configuration of the Control Circuit of the Sheet Processing Apparatus]

Figure 4:
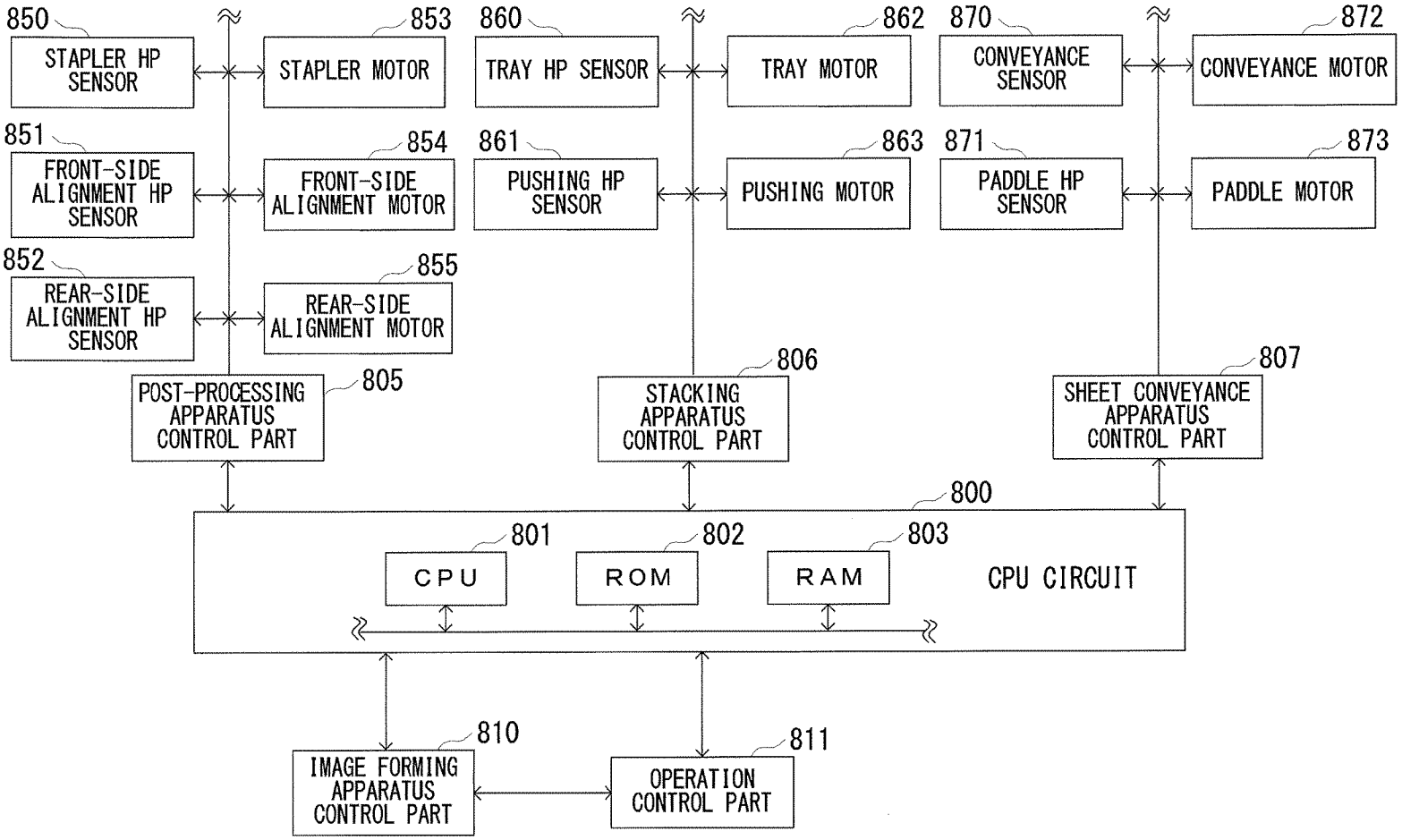
FIG. 4 is a functional block diagram exemplifying a configuration of a control circuit of the sheet processing apparatus.

FIG. 4 is a functional block diagram exemplifying a configuration of a control circuit of the sheet processing apparatus 400.

A central processing unit (CPU) circuit part 800 of the sheet processing apparatus 400 is comprised of a CPU 810, a read only memory (ROM) 802, and a random access memory (RAM) 803. The CPU circuit 800 is a kind of computer, which controls the sheet processing apparatus 400 by executing a predetermined program stored in the ROM 802 with the CPU 801. The RAM 803 temporarily or permanently stores various data required for processing.

A post-processing apparatus control part 805, cooperating with the CPU circuit 800, controls to start or stop of driving a stapler motor 853 for operating the stapler 44, a front-side alignment motor 854 for operating the alignment plate 42*a*, and a rear-side alignment motor 855 for operating the alignment plate 42*b*.

A stapler home position (HP) sensor 850 detects whether or not the stapler 44 stands by at a predetermined home position (HP). A front-side alignment HP sensor 851 detects whether or not the alignment plate 42*a* stands by at a predetermined home position (HP). A rear-side alignment HP sensor 852 detects whether or not the alignment plate 42*b* stands by at a predetermined home position (HP). According to the detection results respectively obtained by the stapler HP sensor 850, the front-side HP sensor 851, and the rear-side HP sensor 852, the post-processing apparatus control part 805 controls the operation of each unit relating to the post-processing of the sheet bundle S.

A stacking apparatus control part 806, cooperating with the CPU circuit 800, controls to start or stop of driving of a tray motor 862 for operating the stacking tray 47 and a pushing motor 863 for operating the sheet bundle pushing rack part 45.

A tray HP sensor 860 detects whether or not the stacking tray 47 stands by at a predetermined home position (HP). A pushing HP sensor 861 detects whether or not the pushing rack part 45 stands by at a predetermined home position (HP). According to the detection results respectively obtained by the tray HP sensor 860 and the pushing HP sensor 861, the stacking apparatus control part 806 controls the operation of each unit relating to the stacking of the sheet bundle S.

A sheet conveyance apparatus control part 807, cooperating with the CPU circuit 800, controls to start or stop of driving a conveyance motor 872 for operating the conveyance roller pair 40 and a paddle motor 873 for operating the sheet-returning paddle 41.

A conveyance sensor 870 detects whether or not there is a sheet to be conveyed. A paddle HP sensor 871 detects whether or not the sheet-returning paddle 41 stands by at a predetermined home position (HP). According to the detection results respectively obtained by the conveyance sensor 870 and the paddle HP sensor 871, the sheet conveyance apparatus control part 807 controls the operation of each unit relating to the conveyance of the sheet and the like.

An image forming apparatus control part 810 controls to transfer various information with the image forming apparatus 300. An operation control part 811 controls to transfer various information with an operation device 600.

[Post-Operation Operating Mode]

Depending on a job mode input via the operation device 600, a position on the processing tray 46 on which the sheet bundle S is formed varies. The position on the processing tray on which the sheet bundle S is formed is realized by changing an alignment position at which the sheet bundle S is aligned with the alignment plate 42. Example of the post-processing mode of the present embodiment includes "shift sort mode" and "staple mode". Description will be made with regard to the difference in terms of the alignment position of the respective modes.

In the shift sort mode, for example, it is controlled such that every time the sheet bundle is formed, its formation position (alignment position) is displaced. In a case where the "shift sort mode" is selected as the post-processing mode, the sheet processing apparatus 400 controls as follows. For example, the sheet processing apparatus 400 moves the alignment plate 42*b*, which is positioned at the front side when viewed from the front of the image forming system, 50 mm to the front side from the center PO (FIG. 3A) in the width direction orthogonal to the conveyance and discharge direction. Then, the sheet processing apparatus 400 drives the alignment plate 42*a* to abut the side end of the sheet to the alignment plate 42*b* thereby aligning the side ends of the sheet. Therefore, the sheet bundle S is formed with reference to a position of 50 mm to the front side from the sheet discharge center PO on the main body. Then, the reference position of the alignment plate 42*b* is offset for each predetermined bundle by 20 mm to the depth side or to the front side, for example. Therefore, the position at which the sheet bundle S is formed is shifted. In addition, the position at which the sheet bundle S is discharged is shifted. As a result, each of the sheet bundles S stacked on the stacking tray is easily distinguished.

Note that, the movement distance of the alignment plate 42*b* for offset is optionally determined taking into consideration of productivity in the image forming system 1000, for example.

In the staple mode, the predetermined binding portion of the sheet bundle S as formed is controlled such that the binding process is performed by the stapler 44. In a case where the "staple mode" is selected as the post-processing mode, the sheet bundle S is formed at a predetermined binding position to perform the binding process. For example, the sheet bundle S is formed at a position where the binding portion of the sheet bundle is arranged in an opening of the stapler 44. Such position is defined as a binding position. The opening of the stapler 44 will be described later. Alternatively, it can be configured such that the sheet bundle S is formed at a position where is convenient for alignment and where is different from the binding position and then, through the use of the alignment plate 42, the sheet bundle S as formed is moved as a bundle (bundle-shift) to the binding position (post-processing position). Then, the sheet bundle S having performed the binding process thereto is discharged onto the stacking tray 47 by the pushing rack part 45.

Note that, it can be configured such that the sheet bundle S having performed the binding process thereto is discharged after the bundle movement of the sheet bundle S. In this case, the larger movement distance of the bundle movement influences productivity in the image forming system 1000 by the time required for the movement. Taking the above into consideration, the movement distance for the bundle movement is optionally set.

As shown in FIG. 3A, in this embodiment, it is configured such that the stapler 44 is arranged at a depth side of the image forming system 1000. For convenience, the binding position where the binding process is performed by the stapler 44, arranged in this manner, is particularly referred to as depth binding position. The staple mode by which the binding process is performed at the depth binding position is particularly referred to as depth binding mode.

The sheet processing apparatus 400 bundle moves, for example, the sheet bundle S comprising of the number of sheets capable of performing the binding process such that predetermined portion of the sheet bundle S is inserted into the opening of the stapler 44 so as to bring the sheet bundle S close to the normal binding discharge reference position P1, as shown FIG. 3B. Then, the binding process is performed to the sheet bundle S which is brought close to the depth binding position. Thereafter, the sheet bundle S having performed the binding process thereto is discharged. In this embodiment, the position at which the sheet bundle S having performed the binding process thereto is discharged in this manner is referred to as a first discharge position.

FIG. 3B is a diagram illustrating each position relation of the sheet bundle S, the stapler 44, and the alignment plate 42 when the sheet bundle S is brought close to the depth binding position. The sheet bundle S having performed the binding process thereto is pushed in the conveyance and discharge direction as shown by the arrow in FIG. 3B. Then, the sheet bundle S is placed on the stacking tray 47 shown by broken line in FIG. 3B.

Further, as to the exceptional bundle which exceeds the number of sheets capable of performing the binding process, the sheet processing apparatus 400 first brings the exceptional bundle close to an exceptional bundle discharge reference position P2, where is the front side of the apparatus of the image forming system 1000. Then, the exceptional sheet bundle is discharged. In this embodiment, the position at which the exceptional bundle is discharged in this manner is referred to as a second discharge position. Compared with the first discharge position, the second discharge position has good visibility for an operator standing on the front of the image forming apparatus. FIG. 3C illustrates each position relation of the exceptional bundle, the stapler 44 and the alignment plate 42 in this case.

Further, when discharging a plurality of exceptional bundles, by offsetting the above-mentioned discharge reference position, identifying the respective exceptional bundles is easily made. FIG. 3C shows a placement position P3 by broken line, where the discharge reference position is offset to the depth side of the apparatus. In this embodiment, the position to which the exceptional bundle is discharged to the offset placement position (for example, placement position P3) is referred to as a third discharge position.

Figure 5:
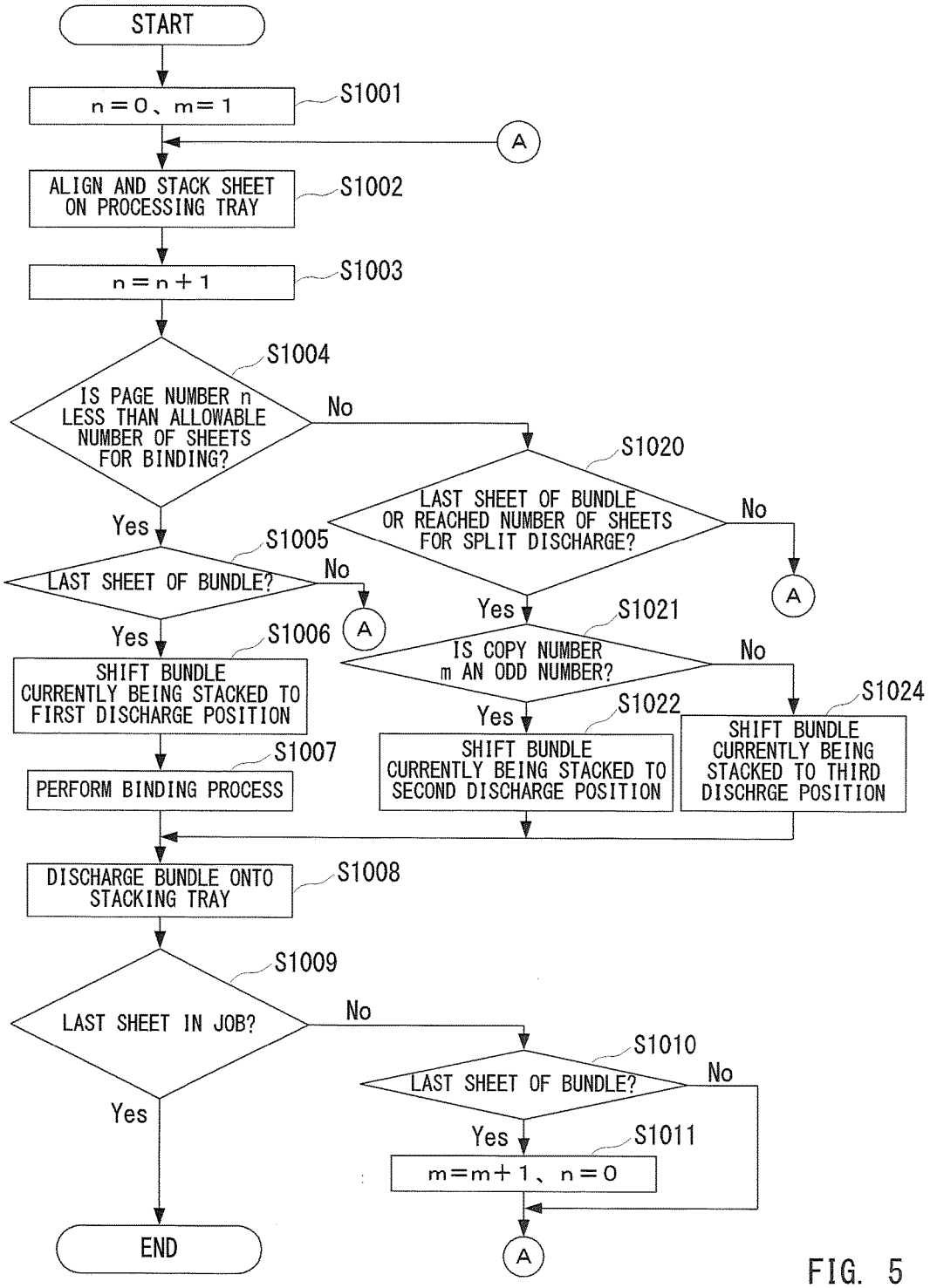
FIG. 5 is a flowchart illustrating a processing procedure of the sheet processing apparatus

FIG. 5 is a flow chart illustrating a process procedure of the sheet processing apparatus 400. An operation control is described with FIG. 5 in a case where the depth-binding mode is selected.

Note that, it is assumed that any initial settings and the like have already been performed to each component device of the image forming system 1000.

Triggered by the start of the depth binding process (start of the depth binding post-processing), the CPU 801 initializes value of page number n to 0 (zero). In addition, the CPU initializes value of copy number m to 1. The page number n represents the number of sheets stored in the RAM 803. The copy number m represents the number of copies of the sheet bundle as formed (S1001). The CPU 801 instructs to start to drive the conveyance roller pair 40, the sheet-returning paddle 41, and the alignment plate 42 respectively. Then, by controlling the sheet-returning paddle 41 and the alignment plate 42, the sheet having the image formed thereon discharged from the image forming apparatus 300 is stacked on the predetermined alignment position on the processing tray 46 (S1002).

Note that the predetermined alignment position may be the above-mentioned binding position. Alternatively, it may be the same position as the first discharge position.

In addition, before receiving the sheet having the image formed thereon from the image forming apparatus 300, the CPU 801 receives job information relating to the sheet from the operation device 600. The job information includes, for example, a flag (bundle last sheet flag) representing whether or not the discharged sheet is the last sheet of the sheet bundle S which is currently being stacked. The job information further includes binding mode designation information, page number, copy number, and flag representing whether or not the bundle is the last bundle in the job. It can be configured such that the job information is received via other apparatus such as the image forming apparatus 300.

The CPU 801 adds 1 to the value of the page number n stored in the RAM 803 (S1003). Therefore, the stacked number of sheets can be managed. Note that, the stacked number of sheets may be managed through a sheet number counter by the RAM 803. In addition, the stacked number of sheets may be managed through storage management of page number based on the job information as obtained.

The CPU 801 determines, based on the value of the page number n, whether or not the number of sheets of the sheet bundle S currently being stacked is less than the allowable number of sheets for binding, that is, less than the number of sheets capable of performing the binding process (S1004). The value of the allowable number of sheets for binding is stored in the RAM 803 beforehand as one of the initial settings, for example, or upon receipt of input from the user via the operation device 600. Note that, in a case where the value of the page number n indicates the same value as the allowable number of sheets for binding, the bundle last sheet flag is also referred. Therefore, in a case where the sheet is found not to be the last sheet of the bundle, it can be determined that the number of sheets of the sheet bundle S obviously exceed the allowable number of sheets for binding. Therefore, the sheet bundle turns out the sheet bundle which is not post-processed because the number of sheets of the sheet bundle exceeds the allowable number of sheets for the post-processing.

Further, in addition to managing through the information such as the page number, it can be configured such that the determination of whether or not the number of sheets exceed the allowable number of sheets for binding is made through the use of any well-known flag type sensor which detects the excessive stacking through contact of flag member with the sheet.

If it is determined that the number of sheets of the sheet bundle S do not exceed the allowable number of sheets for binding (S1004: Yes), the CPU 801 determines whether or not the sheet of n-th page is the last sheet of the sheet bundle S (S1005). If it is determined that the sheet of n-th page is the last sheet of the bundle (S1005: Yes), the CPU 801 controls and drives the alignment plate 42 to shift the sheet bundle S to a first discharge reference position (S1006). If not (S1005: No), the CPU 801 returns to the process of step S1002 (S1005: No).

Note that, it is needless to say that, in a case where the predetermined alignment position in the process of step S1002 is the same position as the first discharge position, this process can be omitted.

The CPU 801 instructs to drive the stapler 44 to perform the binding process of the sheet bundle S (1007). Thereafter, the CPU 801 controls and drives the pushing rack part 45*a* to discharge the sheet bundle S having performed the binding process thereto onto the stacking tray 47 (S1008).

The CPU 801 determines whether or not the sheet of n-th page is the last sheet in the job (S1009). If it is determined that the sheet bundle S is the last bundle and it is the bundle last sheet (S1009: Yes), the depth binding job is ended. If not (S1009: No), it is determined whether or not the sheet of n-th page is the last sheet of the sheet bundle S (S1010).

If it is determined that the sheet of n-th page is not the last sheet of the sheet bundle S (S1010: No), the CPU 801 returns to the process of step S1002. Further, if it is determined that the sheet of n-th page is the last sheet of the sheet bundle S (S1010: Yes), the CPU 801 adds 1 to the value of copy number m stored in the RAM 803, initializes the value of the page number n (S1011), and then, returns to the process of step S1002. Similar to that of the page number n, the information of copy number m may be managed through the sheet number counter by the RAM 803. In addition, the information of copy number m may be managed through storage management of copy number based on the job information as obtained.

Next, description is made in a case where the number of sheets forming of the sheet bundle S exceeds the allowable number of sheets for binding.

If it is determined in the process of step S1004 that the number of sheets of the sheet bundle S exceed the allowable number of sheets for binding (S1004: No), the CPU 801 moves to the process of step S1020. Each process from the step S1020 to the step S1024 is a series of the processes performed to the above-mentioned exceptional bundle.

The CPU 801 determines whether the sheet of the n-th page as received is the last sheet of the sheet bundle S. Alternatively, the CPU 801 determines whether the number of sheets has reached the predetermined number of sheets for split discharge by receiving the sheet of the n-th page (S1020). Here, the predetermined number of sheets for split discharge is the number of sheets which does not cause, even if the sheet bundle is discharged as the exceptional bundle, any inconsistency with the sheet bundle formed thereafter. Alternatively, the predetermined number of sheets for split discharge is the number of sheets that can prevent the occurrence of malfunction such as sheet discharge jam when discharging the exceptional bundle. In this embodiment, these functions, i.e., split discharge and preventing the occurrence of malfunction, are referred to a split bundle-shift function. Note that a value of the number of sheets for split discharge is stored in the RAM 803 beforehand as one of the initial settings, for example, or upon receipt of input from the user via the operation device 600.

If it is determined that the sheet of the n-th page is not the last sheet of the sheet bundle S and the n does not reach the predetermined number of sheets for split discharge (S1020: No), the CPU 801 returns to the process of step S1002. Further, if it is determined that the sheet of the n-th page is the last sheet of the sheet bundle S or if it is determined that the n has reached the predetermined number of sheets for split discharge (S1020: Yes), a value of the copy number m of the sheet bundle is obtained. In a case where the value of the obtained copy number m is an odd number (S1021: Yes), the CPU 801 drives and controls the alignment plate 42 to shift the exceptional bundle (S1022). It means that when the number of sheets reaches the predetermined number of sheets for split discharge, bundle-shift is performed. Therefore, occurrence of malfunction due to the excessive stacking and the like can be prevented. In addition, the exceptional bundle is discharged, for example, onto a second discharge position at the front side of the apparatus where has good visibility for the user. It means that the direction to which the exceptional bundle is shifted is the same direction as a predetermined take-out direction. Therefore, for the user, the visibility of the exceptional bundle is improved and the exceptional bundle can be taken out easily.

In a case where the value of the obtained copy number m is an even number (S1021: No), the CPU 801 shifts the exceptional bundle from the second discharge position to, for example, a third discharge position where is the position offset to 20 mm depth side of the apparatus (S1024). Therefore, occurrence of malfunction due to the excessive stacking and the like can be prevented. In addition, identification of the respective exceptional bundles is easily made.

As above, the sheet processing apparatus of this embodiment enables to discharge the exceptional bundle exceeding the allowable number of sheets for binding to a position where is different from the discharge position of the sheet bundle which was bound normally and where has good visibility (for example, front side of the apparatus). Therefore, the visibility of the sheet bundle discharged without being post-processed (exceptional bundle) can be improved.

Note that, in this embodiment, offset is performed for each bundle such as the second discharge position and the third discharge position. The second discharge position may be the same position as the third discharge position. Further, a plurality of discharge positions different from the second and the third positions may further be provided.

In addition, in the present embodiment, description was made with regard to the configuration example, which shifts the sheet bundle to the first discharge position to perform the binding process thereafter. Other than this, it can be configured as follows, which comprises (i) forming the sheet bundle at the binding position; (ii) performing the binding process at the position; (iii) shifting the sheet bundle to the position where is different from the position where the binding process was performed, and (iv) discharging the sheet bundle. Note that, it can also be configured such that the stapler 44 is movably arranged by a driving mechanism (not shown) to enable the binding process at plural binding positions. Therefore, a plurality of binding modes depending on the binding positions can be set.

Further, in this embodiment, the post-processing is performed based on the allowable number of sheets for binding. The post-processing, however, is performed based not only on the post-processing function itself, but also from the viewpoint such as sheet alignment property or sheet stacking property. For example, assuming that the sheet alignment property can be maintained with 30 sheets of plain paper and 2 sheets of thick paper, both of which are the examples of the sheet. In this case, the upper limit of the allowable number of sheets for binding may also be 30 sheets of plain paper and 2 sheets of thick paper.

Further, in addition to the stapler 44 of the present embodiment, the sheet processing apparatus may comprise other post-processing units such as a stapless stapler, which performs pressurizing and fastening process so as to enable plural kinds of post-processing. There may be a case where the allowable number of sheets for processing varies depending on the post-processing units. In this case, among those post-processing units, the post-processing unit having less allowable number of sheets may be designated to be activated, instead of designating the maximum allowable number of sheets. In this case, as to the designated post-processing unit having less allowable number of sheets, the bundle having the number of sheets exceeding its allowable number may be discharged to the front side of the apparatus. Therefore, in this case, though the number of sheets of the post-processing unit does not reach the allowable number of sheets of the post-processing unit having the maximum allowable number, the sheets are discharged to the front side of the apparatus.

Further, in an embodiment in which a plurality of post-processing function is supported, it can be configured such that, in a case where the number of sheets exceeds the allowable number of sheets for one post-processing function, the post-processing may alternatively be performed by the other post-processing function. Note that, in such a case, it can be configured such that following one of (i) performing the alternative post-processing or (ii) discharging the exceptional bundle without performing the post-processing can be selected.

The embodiments as described above are particularly directed to describe the present invention. The scope of the present invention is not limited to these embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-151638, filed Jul. 22, 2013, which is hereby incorporated by reference herein in its entirety.

What is claimed is:

1. An image forming apparatus comprising:

an image reading unit configured to read an image on a document;

an image forming unit configured to form an image on a sheet based on image data obtained by reading the image on the document;

a binding unit configured to perform binding processing to a sheet bundle including a plurality of sheets received from the image forming unit;

a discharging unit, which is provided in a space between the image reading unit and the image forming unit, configured to discharge the sheet bundle, to which binding processing has been performed by the binding unit, on a stacking tray;

a shift unit configured to shift the sheet received from the image forming unit in a width direction orthogonal to a conveyance direction of the sheet; and a control unit configured to control the shift unit to:

(1) discharge a first sheet bundle at a first discharge position on the stacking tray, the first sheet bundle being a sheet bundle to which the binding processing is designated to be performed and the binding processing has been performed by the binding unit, and (2) discharge a second sheet bundle at a second discharge position on the stacking tray, the second discharge position being different from the first discharge position in the width direction, and the second sheet bundle being a sheet bundle to which the binding processing has not been performed even though the binding processing is designated because the number of the sheets for the sheet bundle exceeds a predetermined number, wherein the second discharge position is shifted in the width direction from the binding unit toward the front side of the image forming apparatus.

2. The image forming apparatus according to claim 1, wherein the binding unit is configured to perform the binding processing with a staple.

3. The image forming apparatus according to claim 1, wherein the control unit is configured to count the number of the sheets received from the image forming unit and to determine whether the number of the sheets exceeds the predetermined number.

4. The image forming apparatus according to claim 1, wherein the binding unit is provided in the space such that a direction to take out the sheets bound by the binding unit via an opening of the image forming apparatus is identical to a direction of shift performed by the shift unit.

5. The image forming apparatus according to claim 1, further comprising a pair of alignment members, one of which contacts one side of the sheets received from the image forming unit in the width direction, and the other of which contacts the other side of the sheets received from the image forming unit in the width direction, wherein the shift unit shifts the sheet received from the image forming unit in the width direction by moving the pair of alignment members.

6. The image forming apparatus according to claim 1, wherein the shift unit is configured to shift the sheet to which the binding process is to be performed to a predetermined binding position.

7. The image forming apparatus according to claim 1, further comprising an operation unit, which is provided at a front side of the image forming apparatus, configured to receive an instruction from an operator.

8. An image forming apparatus comprising:

an image reading unit configured to read an image on a document;

an image forming unit configured to form an image on a sheet based on image data obtained by reading the image on the document;

a binding unit configured to perform binding processing to a sheet bundle including a plurality of sheets received from the image forming unit;

a discharging unit configured to discharge the sheet bundle, to which binding processing has been performed by the binding unit, on a stacking tray, wherein the stacking tray is provided below a bottom surface of a housing which includes the image reading unit;

a shift unit configured to shift the sheet received from the image forming unit in a width direction orthogonal to a conveyance direction of the sheet; and a control unit configured to control the shift unit to:

(1) discharge a first sheet bundle at a first discharge position on the stacking tray, the first sheet bundle being a sheet bundle to which the binding processing is designated to be performed and the binding processing has been performed by the binding unit, and (2) discharge a second sheet bundle at a second discharge position on the stacking tray, the second discharge position being a position closer to, in the width direction, a front side of the image forming apparatus than the first discharge position, and the second sheet bundle being a sheet bundle to which the binding processing has not been performed even though the binding processing is designated because the number of the sheets for the sheet bundle exceeds a predetermined number.

9. An image forming apparatus comprising:

an image reading unit configured to read an image on a document;

an image forming unit configured to form an image on a sheet based on image data obtained by reading the image on the document;

a binding unit configured to perform binding processing to a sheet bundle including a plurality of sheets received from the image forming unit;

a discharging unit configured to discharge the sheet bundle, to which binding processing has been performed by the binding unit, on a stacking tray, wherein the stacking tray is provided below a bottom surface of a housing which includes the image reading unit;

a shift unit configured to shift the sheet received from the image forming unit in a width direction orthogonal to a conveyance direction of the sheet; and a control unit configured to control the shift unit to:

(1) discharge a first sheet bundle at a first discharge position on the stacking tray, the first sheet bundle being a sheet bundle to which the binding processing is designated to be performed and the binding processing has been performed by the binding unit, and (2) discharge a second sheet bundle at a second discharge position on the stacking tray, the second discharge position being a position farther away from, in the width direction, the binding unit than the first discharge position, and the second sheet bundle being a sheet bundle to which the binding processing has not been performed even though the binding processing is designated because the number of the sheets for the sheet bundle exceeds a predetermined number.

10. An image forming apparatus comprising:

an image reading unit configured to read an image on a document;

an image forming unit configured to form an image on a sheet based on image data obtained by reading the image on the document;

a binding unit configured to perform binding processing to a sheet bundle including a plurality of sheets received from the image forming unit;

a discharging unit configured to discharge the sheet bundle, to which binding processing has been performed by the binding unit, on a stacking tray, wherein the sheet bundle is discharged to a space defined by a first housing and a second housing, the first housing including the image reading unit and the second housing including the image forming unit;

a shift unit configured to shift the sheet received from the image forming unit in a width direction orthogonal to a conveyance direction of the sheet; and a control unit configured to control the shift unit to:

(1) discharge a first sheet bundle at a first discharge position on the stacking tray, the first sheet bundle being a sheet bundle to which the binding processing is designated to be performed and the binding processing has been performed by the binding unit, and (2) discharge a second sheet bundle at a second discharge position on the stacking tray, the second discharge position being a position closer to, in the width direction, a front side of the image forming apparatus than the first discharge position, and the second sheet bundle being a sheet bundle to which the binding processing has not been performed even though the binding processing is designated because the number of the sheets for the sheet bundle exceeds a predetermined number.

11. An image forming apparatus comprising:

an image reading unit configured to read an image on a document;

an image forming unit configured to form an image on a sheet based on image data obtained by reading the image on the document;

a binding unit configured to perform binding processing to a sheet bundle including a plurality of sheets received from the image forming unit;

a discharging unit configured to discharge the sheet bundle, to which binding processing has been performed by the binding unit, on a stacking tray, wherein the sheet bundle is discharged to a space defined by a first housing and a second housing, the first housing including the image reading unit and the second housing including the image forming unit;

a shift unit configured to shift the sheet received from the image forming unit in a width direction orthogonal to a conveyance direction of the sheet; and a control unit configured to control the shift unit to:

(1) discharge a first sheet bundle at a first discharge position on the stacking tray, the first sheet bundle being a sheet bundle to which the binding processing is designated to be performed and the binding processing has been performed by the binding unit, and (2) discharge a second sheet bundle at a second discharge position on the stacking tray, the second discharge position being a position farther away from, in the width direction, the binding unit than the first discharge position, and the second sheet bundle being a sheet bundle to which the binding processing has not been performed even though the binding processing is designated because the number of the sheets for the sheet bundle exceeds a predetermined number.

12. An image forming apparatus comprising:

an image reading unit configured to read an image on a document;

an image forming unit configured to form an image on a sheet based on image data obtained by reading the image on the document;

a binding unit configured to perform binding processing to sheets received from the image forming unit;

a discharging unit configured to discharge the sheets, to which binding processing has been performed by the binding unit, on a stacking tray, wherein the stacking tray is provided below a bottom surface of a housing which includes the image reading unit;

a shift unit configured to shift the sheet received from the image forming unit in a width direction orthogonal to a conveyance direction of the sheet; and a control unit configured to control the shift unit to:

(1) discharge first sheets at a first discharge position on the stacking tray, the first sheets being sheets to which the binding processing is designated to be performed and the binding processing has been performed by the binding unit, and (2) discharge second sheets at a second discharge position on the stacking tray, the second discharge position being a position closer to, in the width direction, a front side of the image forming apparatus than the first discharge position, and the second sheets being sheets to which the binding processing has not been performed even though the binding processing is designated because the number of the sheets exceeds a predetermined number.

13. The image forming apparatus according to claim 12, wherein the binding unit is configured to perform the binding processing with a staple.

14. The image forming apparatus according to claim 12, wherein the control unit is configured to count the number of the sheets received from the image forming unit and to determine whether the number of the sheets exceeds the predetermined number.

15. The image forming apparatus according to claim 12, wherein the binding unit is provided in a space between the image reading unit and the image forming unit such that a direction to take out the sheets bound by the binding unit via an opening of the image forming apparatus is identical to a direction of shift performed by the shift unit.

16. The image forming apparatus according to claim 12, further comprising a pair of alignment members, one of which contacts one side of the sheets received from the image forming unit in the width direction, and the other of which contacts the other side of the sheets received from the image forming unit in the width direction, wherein the shift unit shifts the sheet received from the image forming unit in the width direction by moving the pair of alignment members.

17. The image forming apparatus according to claim 12, wherein the shift unit is configured to shift the sheet to which the binding process is to be performed to a predetermined binding position.

18. The image forming apparatus according to claim 12, further comprising an operation unit, which is provided at the front side of the image forming apparatus, configured to receive an instruction from an operator.

* * * * *